US012779523B2

(12) United States Patent
Yoo et al.

(10) Patent No.: US 12,779,523 B2
(45) **Date of Patent: *Nov. 3, 2026**

(54) HOT STAMPING COMPONENT

(71) Applicant: Hyundai Steel Company, Incheon (KR)

(72) Inventors: Byung Gil Yoo, Incheon (KR); Seok Hyeon Kang, Incheon (KR); Dong Yong Kim, Incheon (KR); Je Woo Soo Kim, Incheon (KR); Seong Kyung Han, Incheon (KR)

(73) Assignee: HYUNDAI STEEL COMPANY, Incheon (KR)

( * ) Notice: Subject to any disclaimer, the term of this patent is extended or adjusted under 35 U.S.C. 154(b) by 589 days.

This patent is subject to a terminal disclaimer.

(21) Appl. No.: 18/079,493

(22) Filed: Dec. 12, 2022

(65) Prior Publication Data

US 2023/0132597 A1 May 4, 2023

Related U.S. Application Data

(63) Continuation of application No. PCT/KR2022/001409, filed on Jan. 26, 2022.

(30) Foreign Application Priority Data

Oct. 29, 2021 (KR) ..... 10-2021-0147067

(51) Int. Cl.

| | |
|---|---|
| ***B21D 22/02*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| *C21D 1/18* | (2006.01) |
| *C21D 1/673* | (2006.01) |
| *C21D 6/02* | (2006.01) |
| *C21D 8/00* | (2006.01) |
| *C22C 38/24* | (2006.01) |

(52) U.S. Cl.

CPC ..... *B21D 22/022* (2013.01); *C21D 9/0068* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *B21D 22/02* (2013.01); *C21D 1/18* (2013.01); *C21D 1/673* (2013.01); *C21D 6/02* (2013.01); *C21D 8/00* (2013.01); *C21D 2211/004* (2013.01); *C21D 2211/008* (2013.01); *C22C 38/24* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 10,286,439 | B2 | 5/2019 | Jin et al. | |
| 11,136,653 | B2 | 10/2021 | Um et al. | |
| 11,505,846 | B2 | 11/2022 | Abukawa et al. | |
| 2013/0095347 | A1* | 4/2013 | Kawasaki | B21B 45/00 148/333 |
| 2020/0332382 | A1 | 10/2020 | Takashima et al. | |
| 2021/0147955 | A1 | 5/2021 | Yoo et al. | |
| 2023/0125659 | A1* | 4/2023 | Kim | C22C 38/28 148/330 |
| 2023/0138738 | A1* | 5/2023 | Kim | C22C 38/02 148/645 |

FOREIGN PATENT DOCUMENTS

| | | | |
|---|---|---|---|
| CN | 108368594 | A | 8/2018 |
| DE | 10 2020 201451 | A1 | 8/2021 |
| JP | 2005-029870 | A | 2/2005 |
| JP | 2006-152427 | A | 6/2006 |
| JP | 2014-015638 | A | 1/2014 |
| JP | 2015104753 | A | 6/2015 |
| JP | 2017-043825 | A | 3/2017 |
| JP | 2021-155794 | A | 10/2021 |
| KR | 2018-0095757 | A | 8/2018 |

(Continued)

OTHER PUBLICATIONS

Office Action issued Feb. 22, 2023 in corresponding Korean Patent Application No. 10-2021-0147067.

Office Action issued Feb. 2, 2024 in corresponding Japanese Patent Application No. 2022-575413 (complete English Translation provided).

Extended European Search Report dated Aug. 27, 2025 for corresponding European Patent Application No. 22817056.9.

Yoo JiSung et al. "Effects of Nb or (Nb + Mo) alloying on Charpy impact, bending, and delayed fracture properties in 1.9-GPa-grade press hardening steel" Materials Characterization, Elsevier, New York, NY, US, vol. 176, Apr. 17, 2021, XP086576214.

Office Action for Application No. CN202280072212.3 dated Jul. 7, 2026.

*Primary Examiner* — Jophy S. Koshy

(74) *Attorney, Agent, or Firm* — Fox Rothschild LLP

(57) ABSTRACT

A hot stamping component includes a base steel sheet including carbon (C) in an amount of 0.28 wt % to 0.50 wt %, silicon (Si) in an amount of 0.15 wt % to 0.7 wt %, manganese (Mn) in an amount of 0.5 wt % to 2.0 wt %, phosphorus (P) in an amount of 0.03 wt % or less, sulfur (S) in an amount of 0.01 wt % or less, chromium (Cr) in an amount of 0.1 wt % to 0.6 wt %, boron (B) in an amount of 0.001 wt % to 0.005 wt %, at least one of titanium (Ti), niobium (Nb), and molybdenum (Mo), and a balance of iron (Fe) and other unavoidable impurities. The content of titanium (Ti), niobium (Nb) and molybdenum (Mo) satisfies the following relationship: $0.015 \leq 0.33(Ti+Nb+0.33(Mo)) \leq 0.050$ (unit: wt %).

4 Claims, 6 Drawing Sheets

(56) References Cited

FOREIGN PATENT DOCUMENTS

| | | | |
|---|---|---|---|
| KR | 10-2019-0001226 | A | 1/2019 |
| KR | 101938073 | B1 | 1/2019 |
| KR | 10-2020-0036248 | A | 4/2020 |
| KR | 102110679 | B1 | 5/2020 |
| KR | 2021-0037106 | A | 4/2021 |
| KR | 102262353 | B1 | 6/2021 |
| KR | 10-2021-0080677 | A | 7/2021 |
| WO | 2007/129676 | A1 | 11/2007 |
| WO | 2019/093376 | A1 | 5/2019 |

* cited by examiner

HOT STAMPING COMPONENT

CROSS-REFERENCES TO RELATED APPLICATIONS

This application is a continuation application of PCT/KR2022/001409 filed Jan. 26, 2022, which claims priority of Korean Patent Application 10-2021-0147067 filed on Oct. 29, 2021. The entire contents of these applications are incorporated herein by reference in their entirety.

TECHNICAL FIELD

The present invention relates to a hot stamping component.

BACKGROUND

As environmental regulations and fuel economy regulations are strengthened around the world, the need for lighter vehicle materials is increasing. Accordingly, research and development on ultra-high-strength steel and hot stamping steel are being actively conducted. Among them, the hot stamping process consists of heating/forming/cooling/trimming, and uses the phase transformation of the material and the change of the microstructure during the process.

Recently, studies to improve delayed fracture, corrosion resistance, and weldability occurring in a hot stamping member manufactured by a hot stamping process have been actively conducted. As a related technology, there is Korean Application Publication No. 10-2018-0095757 (Title of the invention: Method of manufacturing hot stamping member).

SUMMARY

Technical Problem

Embodiments of the present invention provide a hot stamping component with improved impact performance.

However, these problems are exemplary, and the scope of the present invention is not limited thereto.

Technical Solution

According to one aspect of the present invention, a hot stamping component is provided, the hot stamping component including a base steel sheet including carbon (C) in an amount of 0.28 wt % to 0.50 wt %, silicon (Si) in an amount of 0.15 wt % to 0.7 wt %, manganese (Mn) in an amount of 0.5 wt % to 2.0 wt %, phosphorus (P) in an amount of 0.03 wt % or less, sulfur (S) in an amount of 0.01 wt % or less, chromium (Cr) in an amount of 0.1 wt % to 0.6 wt %, boron (B) in an amount of 0.001 wt % to 0.005 wt %, at least one of titanium (Ti), niobium (Nb), and molybdenum (Mo), and a balance of iron (Fe) and other unavoidable impurities, wherein a content of titanium (Ti), niobium (Nb) and molybdenum (Mo) satisfies the following equation.

$$0.015 \leq 0.33(Ti+Nb+0.33(Mo)) \leq 0.050 \quad \text{<Equation>}$$

In an exemplary embodiment, in an indentation strain rate for the indentation depth of 200 nm to 600 nm observed in the nano-indentation test, the number of indentation dynamic strain aging may be 25 to 39.

In an exemplary embodiment, the base steel sheet may include a martensitic structure in which a plurality of lath structures are distributed.

In an exemplary embodiment, an average spacing of the plurality of laths may be 30 nm to 300 nm.

In an exemplary embodiment, a the hot stamping component may further include fine precipitates distributed in the base steel sheet, and the fine precipitates include nitride or carbide of at least one of titanium (Ti), niobium (Nb) and molybdenum (Mo).

In an exemplary embodiment, a number of the fine precipitates distributed per unit area (100 $\mu m^2$) may be 25,000 or greater and 30,000 or less.

In an exemplary embodiment, a TiC-based precipitate density distributed per unit area (100 $\mu m^2$) among the fine precipitates may be 20,000 (pcs/100 $\mu m^2$) to 35,000 (pcs/100 $\mu m^2$) or less.

In an exemplary embodiment, an average diameter of the fine precipitates is 0.006 μm or less.

In an exemplary embodiment, the ratio of the fine precipitates having a diameter of 10 nm or less may be 90% or greater.

In an exemplary embodiment, the ratio of the fine precipitates having a diameter of 5 nm or less may be 60% or greater.

In an exemplary embodiment, a V-bending angle of the hot stamping component may be 50° or greater.

In an exemplary embodiment, a tensile strength of the hot stamping component may be 1680 MPa or greater.

In an exemplary embodiment, amount of activated hydrogen of the hot stamping component may be 0.5 wppm or less.

Advantageous Effects

According to an embodiment of the present invention made as described above, it is possible to implement a hot stamping component. Of course, the scope of the present invention is not limited by these effects.

DETAILED DESCRIPTION

Figure 1:
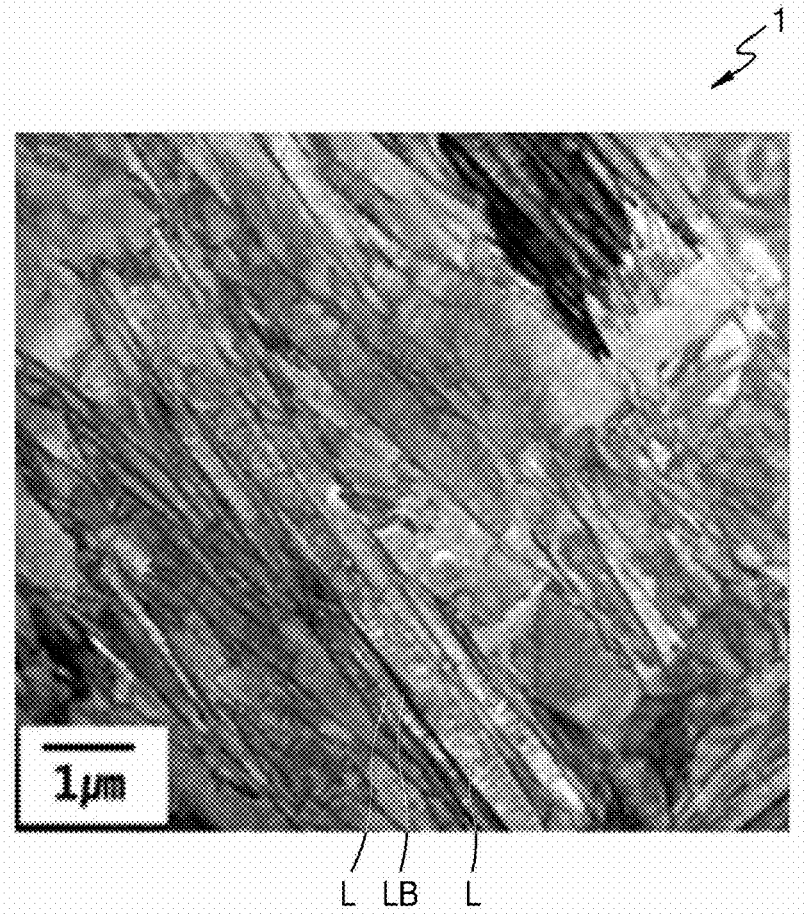
FIG. 1 shows a transmission electron microscopy (TEM) image showing a portion of a hot stamping component according to an exemplary embodiment of the present invention.

Because the present invention may apply various transformations and may have various embodiments, specific embodiments are illustrated in the drawings and described in detail in the detailed description. Effects and features of the present invention, and a method for achieving them, will become apparent with reference to the embodiments described below in detail in conjunction with the drawings.

However, the present invention is not limited to the embodiments disclosed below and may be implemented in various forms.

Hereinafter, embodiments of the present invention will be described in detail with reference to the accompanying drawings, and when described with reference to the drawings, the same or corresponding components are given the same reference numerals, and the overlapping description thereof will be omitted.

In the present specification, terms such as first, second, etc. are used for the purpose of distinguishing one component from another without limiting meaning.

In this specification, the singular expression includes the plural expression unless the context clearly dictates otherwise.

In the present specification, the terms include or have means that the features or components described in the specification are present, and the possibility that one or more other features or components may be added is not excluded in advance.

In the present specification, when it is said that a portion such as a film, region, or component is on or on another portion, it includes not only the case where it is directly on the other portion, but also the case where another film, region, component, etc. is interposed therebetween.

In the present specification, when a film, region, or component is connected, this includes cases in which films, regions, and components are directly connected, and/or cases in which other films, regions, and components are interposed between the films, regions, and components to be indirectly connected. For example, in the present specification, when it is said that a film, region, component, etc. is electrically connected, it refers to a case in which a film, region, or component is directly electrically connected and/or a case in which another film, region, or component is interposed therebetween is indirectly electrically connected.

In the present specification, "A and/or B" refers to A, B, or A and B. And, "at least one of A and B" represents the case of A, B, or A and B.

In the present specification, in cases where certain embodiments are otherwise practicable, a specific process sequence may be performed different from the described sequence. For example, the two processes described in succession may be performed substantially simultaneously, or may be performed in an order opposite to the described order.

In the drawings, the size of the components may be exaggerated or reduced for convenience of description. For example, because the size and thickness of each component shown in the drawings are arbitrarily indicated for convenience of description, the invention is not necessarily limited to what is shown.

FIG. 1 shows a transmission electron microscopy (TEM) image showing a portion of a hot stamping component according to an exemplary embodiment of the present invention.

Referring to FIG. 1, the hot stamping component may include a base steel sheet. The base steel sheet may be a steel sheet manufactured by performing a hot rolling process and/or a cold rolling process on a slab cast to contain a predetermined alloying element in a predetermined content. In one embodiment, the base steel sheet may include carbon (C), silicon (Si), manganese (Mn), phosphorus (P), sulfur (S), chromium (Cr), boron (B) and the balance of iron (Fe), and other unavoidable impurities. In addition, in one embodiment, the base steel sheet may further include at least one of titanium (Ti), niobium (Nb), and molybdenum (Mo) as an additive. In another embodiment, the base steel sheet may further include a predetermined amount of calcium (Ca).

Carbon (C) functions as an austenite stabilizing element in the base steel sheet. Carbon is the main element that determines the strength and hardness of the base steel sheet, and is added for the purpose of securing the tensile strength and yield strength (e.g., tensile strength of 1,680 MPa or greater and yield strength of 950 MPa or greater) of the base steel sheet and securing the hardenability characteristics after the hot stamping process. Such carbon may be included in an amount of 0.28 wt % to 0.50 wt % based on the total weight of the base steel sheet. When the carbon content is less than 0.28 wt %, it is difficult to secure a hard phase (martensite, etc.), so it is difficult to satisfy the mechanical strength of the base steel sheet. In contrast, when the carbon content exceeds 0.50 wt %, a problem of brittleness or bending performance reduction of the base steel sheet may be caused.

Silicon (Si) functions as a ferrite stabilizing element in the base steel sheet. Silicon (Si) as a solid solution strengthening element improves the strength of the base steel sheet and improves the carbon concentration in austenite by suppressing the formation of carbides in the low-temperature region. In addition, silicon is a key element in hot-rolling, cold-rolling, hot-pressing, hot-pressed structure homogenization (control of perlite, manganese segregation zone), and fine dispersion of ferrite. Silicon serves as a martensitic strength heterogeneity control element to improve collision performance. Such silicon may be included in an amount of 0.15 wt % to 0.7 wt % based on the total weight of the base steel sheet. When the content of silicon is less than 0.15 wt %, it is difficult to obtain the above-mentioned effect, cementite formation and coarsening may occur in the final hot stamping martensitic structure, the uniformity effect of the base steel sheet is insignificant, and the V-bending angle may not be secured. In contrast, when the content of silicon exceeds 0.7 wt %, the hot-rolled and cold-rolled loads increase, the hot-rolled red scale becomes excessive, and the plating properties of the base steel sheet may deteriorate.

Manganese (Mn) functions as an austenite stabilizing element in the base steel sheet. The manganese is added to increase hardenability and strength during heat treatment. Such manganese may be included in 0.5 wt % to 2.0 wt % based on the total weight of the base steel sheet. When the content of manganese is less than 0.5 wt %, the hardenability effect is not sufficient, and thus the hard phase fraction in the molded article after hot stamping may be insufficient due to insufficient hardenability. On the other hand, when the manganese content exceeds 2.0 wt %, ductility and toughness may be reduced due to manganese segregation or pearlite bands, and it may cause a decrease in bending performance may occur and a heterogeneous microstructure may occur.

Phosphorus (P) may be included in an amount greater than 0 wt % and less than or equal to 0.03 wt % based on the total weight of the base steel sheet in order to prevent deterioration in toughness of the base steel sheet. When the content of phosphorus exceeds 0.03 wt %, a phosphide iron compound may be formed to deteriorate toughness and weldability, and cracks may occur in the base steel sheet during the manufacturing process.

Sulfur (S) may be included in an amount greater than 0 wt % and 0.01 wt % or less based on the total weight of the base steel sheet. When the sulfur content exceeds 0.01 wt %, hot workability, weldability and impact properties are deteriorated, and surface defects such as cracks may occur due to the formation of large inclusions.

Chromium (Cr) is added for the purpose of improving the hardenability and strength of the base steel sheet. The chromium makes it possible to refine grains and secure strength through precipitation hardening. Such chromium may be included in 0.1 wt % to 0.6 wt % based on the total weight of the base steel sheet. When the chromium content is less than 0.1 wt %, the precipitation hardening effect is poor, and on the contrary, when the chromium content exceeds 0.6 wt %, the amount of Cr-based precipitates and matrix solid solution increases, resulting in a decrease in toughness and an increase in production cost due to cost increase.

Boron (B) is added for the purpose of securing hardenability and strength of the base steel sheet by suppressing ferrite, pearlite, and bainite transformations to secure a martensite structure. In addition, the boron is segregated at grain boundaries to lower grain boundary energy to increase hardenability, and has an effect of grain refinement by increasing austenite grain growth temperature. Such boron may be included in an amount of 0.001 wt % to 0.005 wt % based on the total weight of the base steel sheet. When boron is included in the above range, it is possible to prevent grain boundary brittleness in the hard phase and to secure high toughness and bendability. When the boron content is less than 0.001 wt %, the hardenability effect is insufficient, and on the contrary, when the boron content exceeds 0.005 wt %, the solid solubility is low, so it is easily precipitated at the grain boundary depending on the heat treatment conditions, which may cause deterioration of hardenability or high temperature embrittlement, and toughness and bendability may be deteriorated due to grain boundary brittleness in the hard phase.

On the other hand, fine precipitates may be included in the base steel sheet according to an exemplary embodiment of the present invention. Additives constituting some of the elements included in the base steel sheet may be nitride or carbide forming element that contributes to the formation of fine precipitates.

The additive may include at least one of titanium (Ti), niobium (Nb), and molybdenum (Mo). Titanium (Ti), niobium (Nb), and molybdenum (Mo) may form fine precipitates in the form of nitrides or carbides, thereby securing the strength of hot stamped and quenched members. In addition, these elements are contained in the Fe—Mn-based composite oxide, function as hydrogen trap sites effective for improving delayed fracture resistance, and are elements necessary for improving delayed fracture resistance.

In more detail, the titanium (Ti) may be added for the purpose of strengthening grain refinement and improving the material by forming precipitates after hot press heat treatment, and may effectively contribute to the refinement of austenite grains by forming precipitated phases such as TiC and/or TiN at high temperatures. Such titanium may be included in an amount of 0.025 wt % to 0.045 wt % based on the total weight of the base steel sheet. When titanium is included in the above content range, it is possible to prevent poor performance and coarsening of precipitates, easily secure physical properties of the steel, and prevent defects such as cracks on the surface of the steel. On the other hand, when the content of titanium exceeds 0.045 wt %, precipitates may be coarsened, resulting in reduction in elongation and bendability.

Niobium (Nb) and molybdenum (Mo) are added for the purpose of increasing strength and toughness depending on a decrease in martensite packet size. Niobium may be included in an amount of 0.015 wt % to 0.045 wt % based on the total weight of the base steel sheet. In addition, molybdenum may be included in an amount of 0.05 wt % to 0.15 wt % based on the total weight of the base steel sheet. When niobium and molybdenum are included in the above range, the effect of refining the grains of the steel material is excellent in the hot rolling and cold rolling process, and it is possible to prevent cracking of the slab and brittle fracture of the product during steelmaking/casting, and to minimize the generation of coarse precipitates in steelmaking.

In an exemplary embodiment, the content of titanium (Ti), niobium (Nb) and molybdenum (Mo) may satisfy the following <Equation>.

$$0.015 \leq 0.33(Ti+Nb+0.33(Mo)) \leq 0.050 \text{ (unit: wt \%)} \quad \text{<Equation>}$$

When the contents of titanium (Ti), niobium (Nb), and molybdenum (Mo) are included within the range of the above equation, poor performance and coarsening of precipitates may be prevented, the physical properties of the steel material may be easily secured, and defects such as cracks on the surface of the steel material may be prevented. In addition, the effect of refining grain of steel materials is excellent in hot rolling and cold rolling process, and it is possible to prevent cracking of slabs and brittle fractures of products during steelmaking/casting, and to minimize the generation of coarse precipitates in steelmaking.

When the value of the above equation exceeds 0.050 wt %, the precipitate may be coarsened, resulting in a decrease in elongation and bendability. In addition, when the value of the above equation is less than 0.015 wt %, sufficient fine precipitates may not be formed in the base steel sheet, thereby weakening the hydrogen embrittlement of the hot stamping component and failing to secure sufficient yield strength.

As described above, the hot stamping component according to an exemplary embodiment of the present invention may include fine precipitates containing nitride or carbide of at least one of titanium (Ti), niobium (Nb), and molybdenum (Mo) in the base steel sheet. In addition, these fine precipitates may improve the hydrogen embrittlement of hot stamping components by providing trap sites for hydrogen introduced into the hot stamping components during or after manufacturing.

In an exemplary embodiment, the number of fine precipitates formed in the base steel sheet may be controlled to satisfy a preset range. In one embodiment, the fine precipitates may be included in the base steel sheet in an amount of 25,000 pieces/100 $\mu m^2$ or greater and 30,000 pieces/100 $\mu m^2$ or less. In addition, In one embodiment, the average diameter of the fine precipitates distributed in the base steel sheet may be about 0.006 μm or less, preferably about 0.002 μm to about 0.006 μm. Among these fine precipitates, the ratio of fine precipitates having a diameter of 10 nm or less may be about 90% or greater, and the ratio of fine precipitates having a diameter of 5 nm or less may be about 60% or greater. The hot stamping component including the fine precipitates within the above conditions not only have excellent V-bending characteristics, so they have excellent bendability and crash performance, but also hydrogen delayed fracture characteristics may be improved.

The diameter of such fine precipitates may have a great influence on the improvement of the hydrogen delayed fracture characteristics. When the number, size, and ratio of the fine precipitates are formed within the above-described range, it is possible to secure a required tensile strength (e.g., 1,680 MPa) after hot stamping and improve formability or bendability. For example, when the number of fine precipitates per unit area (100 $\mu m^2$) is less than 25,000/100 $\mu m^2$, the strength of the hot stamping component may be reduced, and when the number exceeds 30,000/100 $\mu m^2$, the formability or bendability of the hot stamping component may deteriorate.

In addition, in an exemplary embodiment, the amount of activated hydrogen in the base steel sheet may be about 0.5 wppm or less. The amount of activated hydrogen refers to an amount of hydrogen excluding hydrogen trapped in fine precipitates among hydrogen introduced into the base steel sheet. Such an amount of activated hydrogen may be measured using a thermal desorption spectroscopy method. In detail, while heating the specimen at a preset heating rate and raising the temperature, the amount of hydrogen released from the specimen below a specific temperature may be measured. In this case, hydrogen released from the specimen below a certain temperature may be understood as activated hydrogen that is not trapped among the hydrogen introduced into the specimen and affects delayed hydrogen destruction. For example, as a comparative example, when the hot stamping component includes greater than 0.5 wppm of activated hydrogen in the base steel sheet, the hydrogen delayed fracture characteristic is reduced, and it may be easily broken compared to the hot stamping component according to an exemplary embodiment in the bending test under the same conditions.

On the other hand, the base steel sheet according to the present embodiment may include a martensitic structure in which a microstructure is distributed. The martensitic structure is the result of the diffusionless transformation of austenite y below the onset temperature (Ms) of martensitic transformation during cooling. The fine structure in the martensitic structure is a diffusionless transformation structure formed during rapid cooling within the grain called a prior austenite grain boundary (PAGB), and may include a plurality of lath (L) structures. A plurality of lath (L) structures may further configure units such as blocks and packets. In more detail, a plurality of lath (L) structures may form a block, a plurality of blocks may form a packet, and a plurality of packets may form an initial austenite grain boundary (PAGB).

As mentioned above, martensite may have a lath (L) structure in the form of a long and thin rod oriented in one direction within each initial grain of austenite. The plurality of lath (L) structures may have a property of resisting external deformation at a boundary between them, that is, a lath boundary (LB). This will be described in detail below.

On the other hand, the V-bending angle of the hot stamping component according to the present embodiment may be 50° or greater. 'V-bending' is a parameter that evaluates the bending deformation properties in the maximum load ranges among the deformations in the bending performance of hot stamping components. That is, examining the tensile strain region during bending at the macroscopic and microscopic scales according to the load-displacement evaluation of hot stamping components, when micro cracks are generated and propagated in the local tensile region, the bending performance called V-bending angle may be evaluated.

As mentioned above, the hot stamping component according to an exemplary embodiment may include a martensitic structure having a plurality of lath L structures, and cracks generated during bending deformation may be generated as one-dimensional defects called dislocations move through interactions within the martensitic structure. In this case, it may be understood that as the local strain rate of the given plastic deformation has a greater value, the degree of energy absorption for the plastic deformation of martensite increases, and thus the impact performance increases.

In the hot stamping component according to an exemplary embodiment of the present invention, as the martensite structure has a plurality of lath L structures, dynamic strain aging (DSA) due to the difference in strain rate in the process of the dislocation repeatedly moving between the lath L and the lath boundary LB during bending deformation, that is, indentation dynamic strain aging may appear. Indentation dynamic strain aging is a concept of plastic strain absorption energy and means resistance to deformation. Therefore, the more frequent indentation dynamic strain aging occurs, the better the resistance to deformation.

In the hot stamping component according to an exemplary embodiment of the present invention, because the martensitic structure has a plurality of lath L structures in a dense form, a press-in dynamic strain aging phenomenon may occur frequently, and through this, it is possible to improve bendability and crash performance by securing a V-bending angle of 50° or greater.

In an exemplary embodiment, an average spacing of the plurality of laths L included in the martensitic structure of the hot stamping component may be about 30 nm to about 300 nm. As a comparative example, it is assumed that a hot stamped component including a base steel sheet deviating from a composition of elements of the elements described above includes a lath structure. The average spacing between the lath structures of the hot stamping component of the comparative example may be greater than the average spacing of the lath L structures of the hot stamping component according to the present embodiment. That is, the hot stamping component according to the exemplary embodiment may have a more dense lath (L) structure than the comparative example, and as the lath (L) structure in the hot stamping component becomes denser, the number of press-in dynamic strain aging may further increase.

Figure 2:
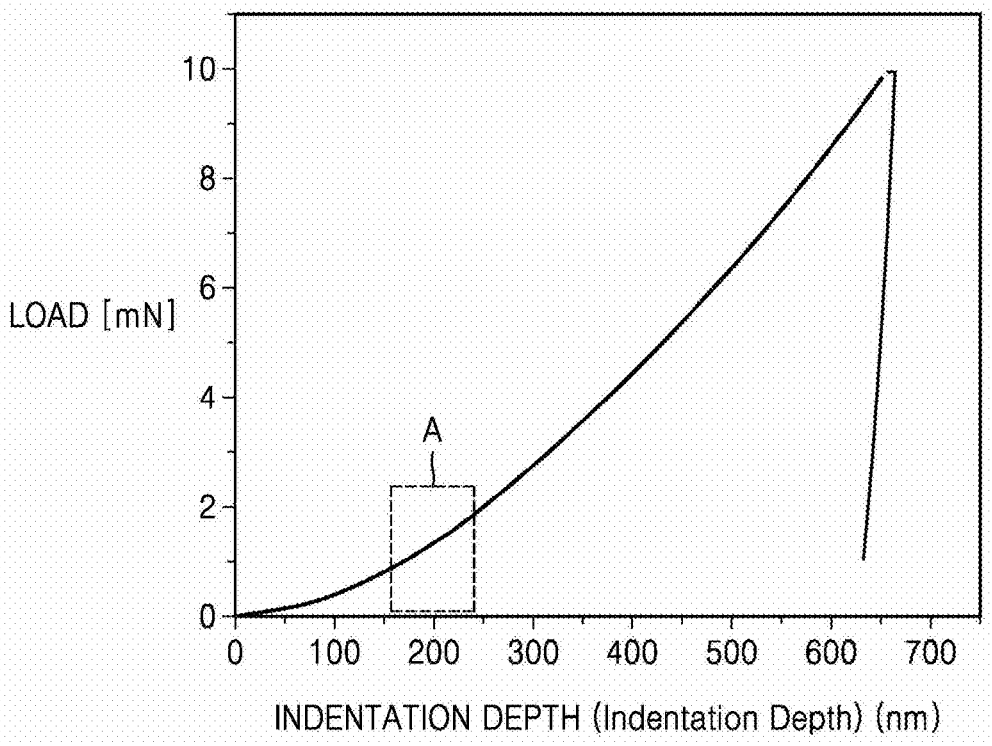
FIG. 2 shows a load-displacement graph according to a nano-indentation test of a hot stamping component according to an exemplary embodiment of the present invention.
Figure 3:
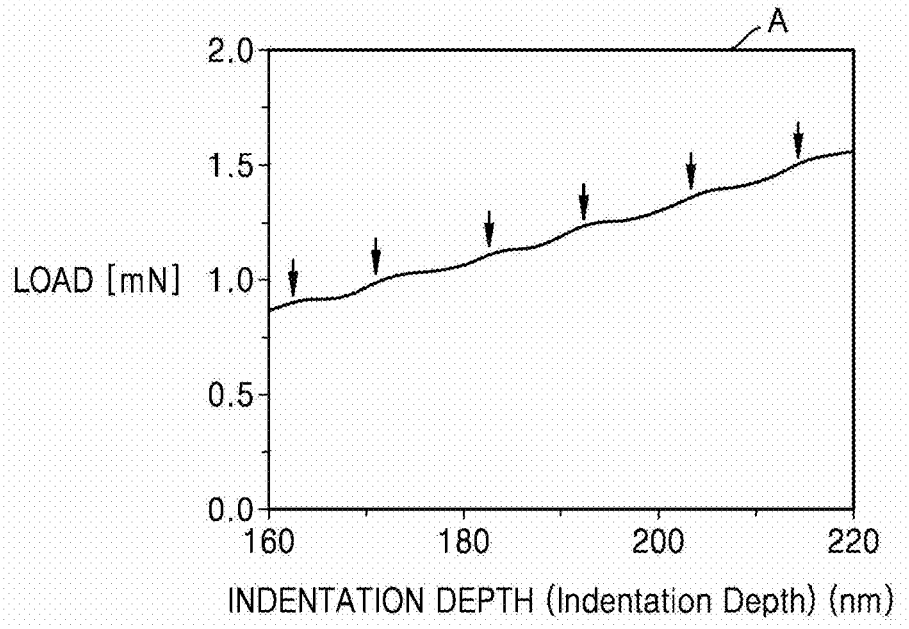
FIG. 3 shows an enlarged view illustrating a serration behavior of portion A of FIG. 2.

FIG. 2 shows a load-displacement graph according to a nano-indentation test of a hot stamping component according to an exemplary embodiment of the present invention, and FIG. 3 is an enlarged view illustrating a serration behavior of portion A of FIG. 2.

Referring to FIG. 2, a graph showing the results of a nano-indentation test on a hot stamping component according to an exemplary embodiment of the present invention is shown. The 'nano indentation test' is a test in which an indenter is pressed vertically on the surface of a hot stamping component to measure force deformation depending on depth. In FIG. 2, the x-axis represents the depth at which the indenter is pushed, and the y-axis represents the force depending on the depth of the press-in. For example, in FIG. 2, a cube-corner tip (centerline-to-face angle=35.3°, indentation strain rate=0.22) was used as an indenter, but the present invention is not limited thereto, and a Berkovich tip (centerline-to-face angle=65.3°, indentation strain rate=0.072) may also be used.

Referring to FIG. 3, which is an enlarged view of portion A of FIG. 2, it may be seen that a characteristic behavior called serration, i.e., serration, is observed during indentation and plastic deformation occurring during the nano-indentation test. The serration behavior may appear repeatedly at approximately regular intervals, and in FIG. 3, the serration behavior is indicated by a downward arrow (↓).

Serration behavior may appear due to non-diffusive transformation structures within the initial austenite grain boundary (PAGB) included in the indentation test of a hot stamping component. In more detail, the serration behavior shown in the load-displacement curve as shown in FIG. 2 is caused by the interaction of dislocations and solute atoms diffusing in the material, and it may be understood that the serration behavior originates from a difference in resistance to external pressure between at a plurality of laths distributed in the initial austenite grain boundary (PAGB) and at the lath boundary portion formed between the plurality of laths. This serration behavior may be recognized as a main evidence of dynamic strain aging (DSA), that is, indentation dynamic strain aging phenomenon of FIG. 4 to be described later.

Figure 4:
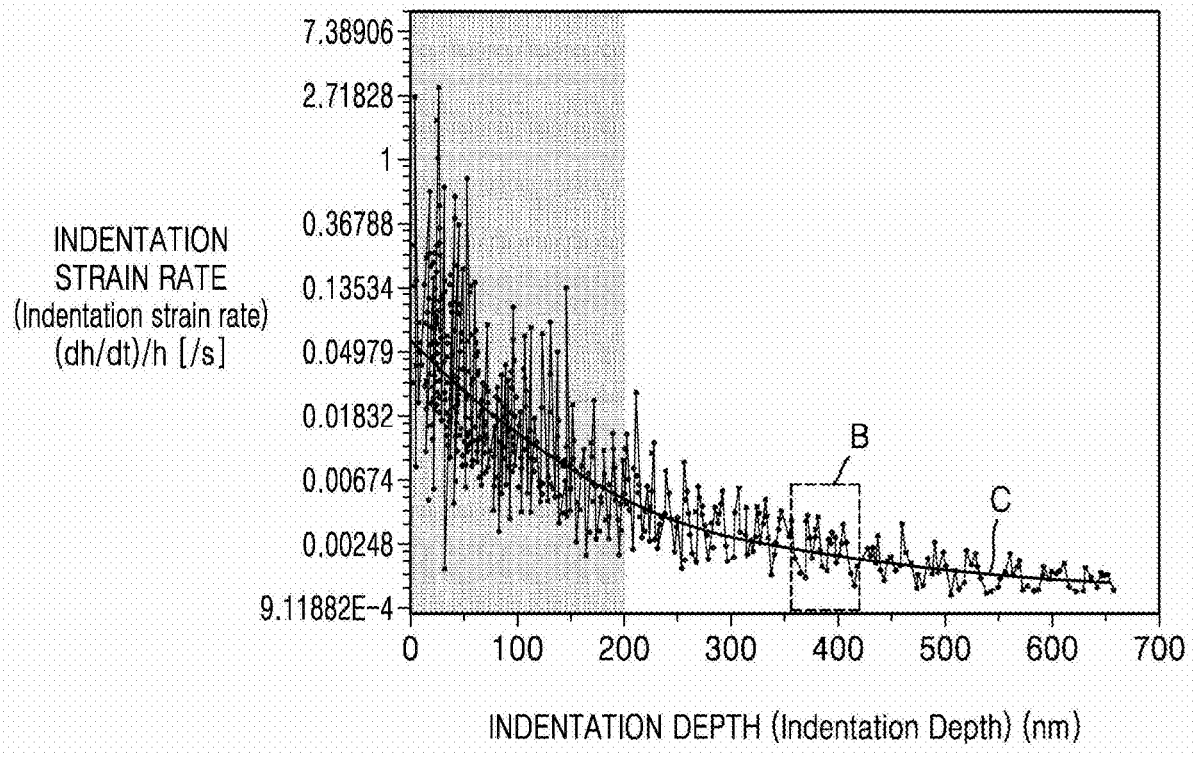
FIG. 4 shows a graph measuring indentation dynamic strain aging.
Figure 5:
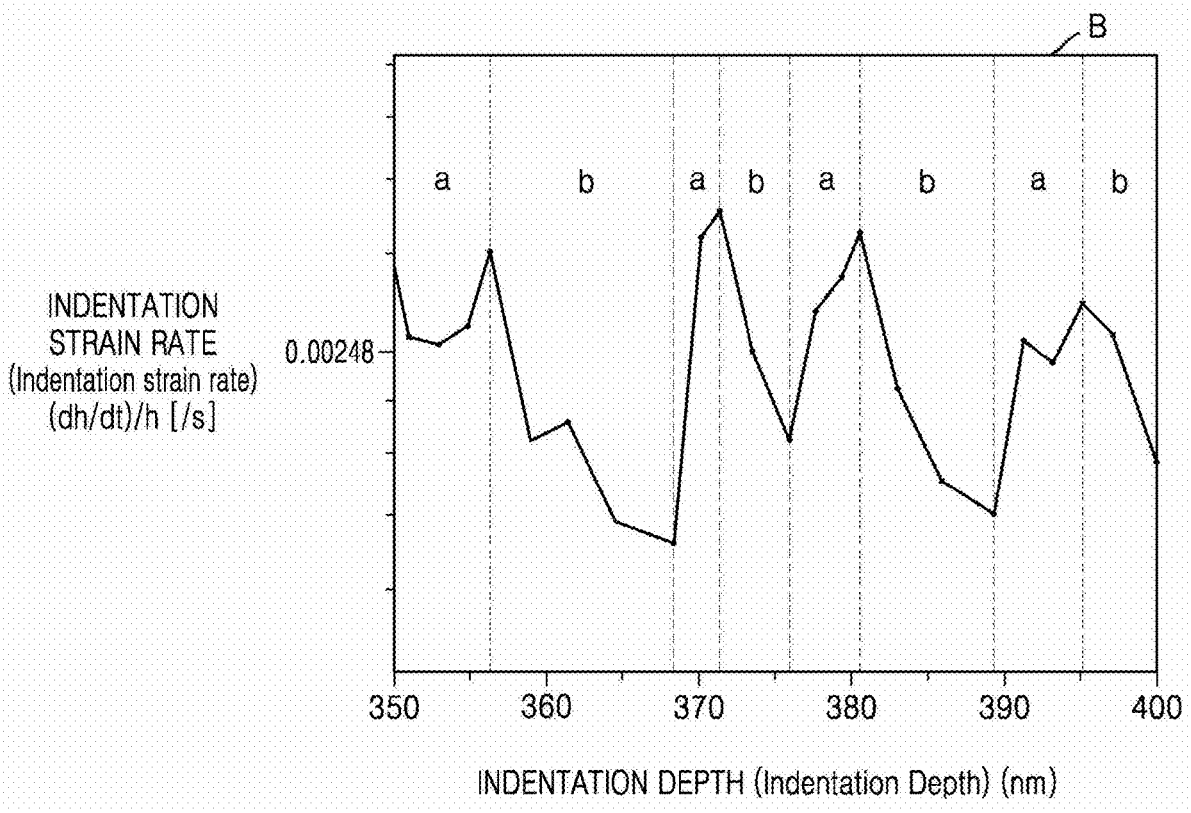
FIG. 5 shows an enlarged view illustrating an enlarged portion B of FIG. 4.

FIG. 4 shows a graph measuring indentation dynamic strain aging, and FIG. 5 shows an enlarged view illustrating an enlarged portion B of FIG. 4.

FIG. 4 is a graph obtained by analyzing the nano-indentation strain rate ([dh/dt]/h, h: indentation depth, t: unit time) based on the load-displacement curve of FIG. 3.

In an exemplary embodiment, in the hot stamping component, the number of indentation dynamic strain aging may be about 25 to 39 in an indentation strain rate for the indentation depth of about 200 nm to 600 nm observed in the nano indentation test. Indentation dynamic strain aging may appear as a behavior in which an indentation strain rate repeatedly forms a plurality of peaks.

The number of indentation dynamic strain aging can be calculated based on the peak passing through the reference line (C) as the center. That is, the number of indentation dynamic strain aging may be calculated based on peaks formed passing through the reference line C without calculating peaks formed above or below the reference line C centered on the reference line C. The reference line C is a line assumed when the indentation dynamic strain aging due to the lath and lath boundary structure is removed when the indentation strain rate is measured.

Referring to the indentation strain graph of FIG. 5, it may be seen that the number and size of indentation dynamic strain aging gradually decrease when the indentation depth becomes deeper. This is because the indentation physical properties of the initial austenite grain are mixed as the indentation depth becomes deeper, so that indentation dynamic strain aging hardly appears. Referring to FIG. 4, it may be seen that substantially no indentation dynamic strain aging occurs at an indentation depth of 600 nm or greater. In the graph of FIG. 4, an indentation depth of 700 nm or greater is not measured, but when the indentation strain is continuously measured for an indentation depth of 700 nm or greater, a curve in which dynamic strain aging is removed may be obtained. The reference line C may be derived by inversely estimating the indentation strain curve at the indentation depth from which the indentation dynamic strain aging is removed.

As mentioned above, the number of indentation dynamic strain aging of the hot stamping component according to an exemplary embodiment may be 25 to 39, based on measurements in the indentation depth range of about 200 nm to 600 nm. In FIG. 4, the indentation depth was measured from 0 nm to about 700 nm, but this is because the accuracy of the indentation strain rate is low due to the influence of the blunted indenter at an indentation depth of less than about 200 nm, and the evaluation of dynamic strain aging is not easy because the indentation properties of the initial austenite grain itself are mixed when the indentation depth exceeds about 600 nm.

As shown in FIG. 4, in a macroscopic view, the indentation strain rate gradually decreases in a quadratic function depending on the indentation depth. In this case, the indentation dynamic strain aging may appear as a behavior in which a plurality of peaks are repeatedly formed in the indentation strain rate. In order to observe this in detail, in FIG. 5, the indentation strain rate for the indentation depth of 350 nm to 400 nm of FIG. 4 is enlarged and shown.

Referring to FIG. 5, the indentation strain rate may appear in the form of repeating a rising section and a falling section. Section a is a section in which an indentation strain rate increases during an indentation test, and may mean a section in which resistance is absorbed. That is, section a may be understood as a section in which dislocations glide within the lath distributed in the initial austenite grain boundary when dislocations move in the tension generating portion during bending deformation. As such, while the dislocation moves within the lath, the hot stamping portion exhibits a property of absorbing external resistance, which may appear as a section in which the indentation strain increases as shown in FIG. 5. The dislocation rises to the lath boundary, and at the moment it passes the lath boundary, the indentation strain decreases like section b, which may be interpreted as a phenomenon caused by interaction with the fine precipitates distributed on the lath boundary.

Figure 6:
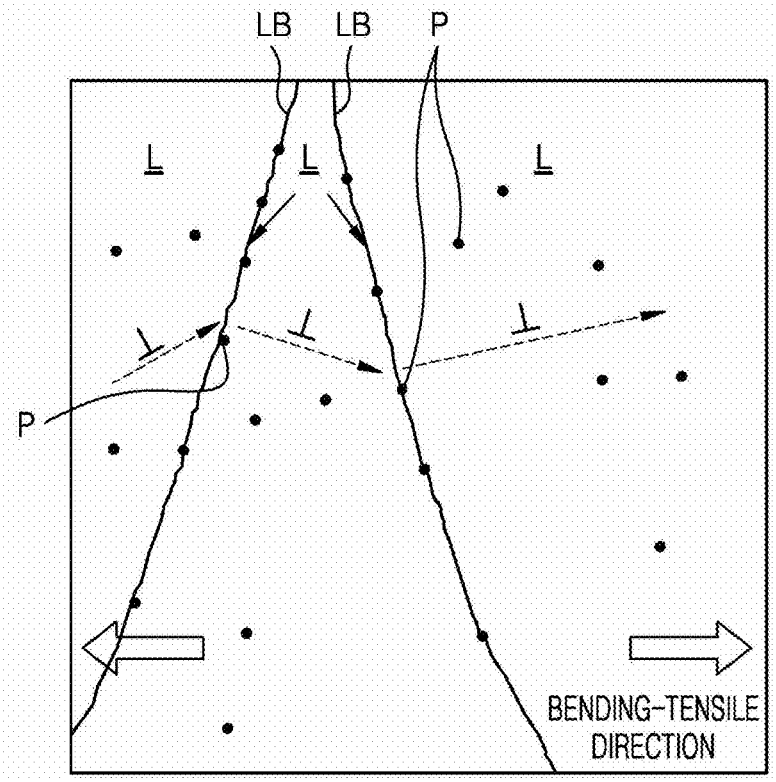
FIG. 6 shows a schematic diagram illustrating a mechanism of indentation dynamic deformation aging depending on the movement of dislocations at the lath and lath boundaries of the hot stamping component according to an exemplary embodiment of the present invention.

FIG. 6 is a schematic diagram illustrating a mechanism of indentation dynamic deformation aging depending on the movement of dislocations at the lath and lath boundaries of the hot stamping component according to an exemplary embodiment of the present invention.

Referring to FIG. 6, while showing laths (L) and lath boundaries (LB) distributed in the initial austenite grain boundary (PAGB) in the tensile generating portion during bending deformation, the movement of dislocations depending on indentation dynamic strain aging in FIG. 5 is schematically shown. As mentioned above, during bending deformation, dislocations may move along adjacent laths (L). The arrow in FIG. 6 indicates the direction of movement of the dislocation.

From the above, it may be interpreted that the indentation strain rates depending on the degree of energy absorption within the lath L and at the lath boundary LB during dislocation movement are different from each other. Referring to FIG. 5 and FIG. 6 together, while the potential moves along the arrow in FIG. 6 within the lath L, it may correspond to section a in FIG. 5. That is, while the dislocation moves within the lath L, the indentation strain rate may increase. The indentation strain rate rises until the dislocation approaches the lath boundary LB, and then falls at the moment it passes the lath boundary LB, which may correspond to section b in FIG. 5. In this way, indentation dynamic strain aging as shown in FIG. 5 may occur due to the interaction between the dislocation and the lath boundary LB during dislocation movement. As described above, fine precipitates P are distributed in the lath boundary LB to show the characteristic of delaying deformation, and in this way, the increase and decrease of the strain rate may be repeatedly formed while passing through the plurality of laths L to generate indentation dynamic strain aging.

The hot stamping component according to an exemplary embodiment of the present invention may have a characteristic in which an indentation dynamic strain aging phenomenon occurs more frequently when a dislocation slides during bending deformation by reducing an average interval between a plurality of laths by controlling fine precipitates included in the base steel sheet. As the indentation dynamic strain aging phenomenon increases through the densification of the lath structure, the hot stamping component according to an embodiment of the present invention may secure a V-bending angle of 50° or greater without breaking during bending deformation, and through this, bendability and crash performance may be improved.

Hereinafter, the present invention will be described in more detail through examples and comparative examples. However, the following examples and comparative examples are intended to explain the present invention in more detail, and the scope of the present invention is not limited by the following examples and comparative examples. The following examples and comparative examples may be appropriately modified or changed by those skilled in the art within the scope of the present invention.

The hot stamping component according to an exemplary embodiment of the present invention may be formed through a hot stamping process for a base steel sheet having a composition as shown in Table 1 below.

TABLE 1

| Ingredients (wt %) | | | | | | | | | | | |
|---|---|---|---|---|---|---|---|---|---|---|---|
| C | Si | Mn | P | S | Cr | B | N | Ca | Ti | Nb | Mo |
| 0.28~ 0.35 | 0.15~ 0.50 | 0.8~ 1.6 | 0.018 or less | 0.005 or less | 0.10~ 0.30 | 0.0015~ 0.0050 | 0.005 or less | 0.0012~ 0.0022 | 0.025~ 0.045 | 0.015~ 0.045 | 0.05~ 0.15 |

As mentioned above, the hot stamping component according to an embodiment of the present invention may include fine precipitates including nitrides and/or carbides of additives in a base steel sheet, and fine precipitates in hot stamping components may be included in an amount of 25,000/100 $\mu m^2$ or greater and 30,000/100 $\mu m^2$ or less per unit area (100 $\mu m^2$) in the base steel sheet. In addition, in an exemplary embodiment, the average diameter of the fine precipitates distributed in the base steel sheet may be 0.006 μm or less, more particularly, about 0.002 μm to 0.0006 μm. In the case of a hot stamping component satisfying the above-mentioned conditions, the V-bending angle may be 50° or greater.

As mentioned above, the additive may include titanium (Ti), niobium (Nb) and molybdenum (Mo), and their content may satisfy the following equation.

$$0.015 \leq 0.33(Ti+Nb+0.33(Mo)) \leq 0.050 \text{ (unit: wt \%)} \quad \text{<Equation>}$$

Table 2 below shows the values measured by digitizing the precipitation behavior of the fine precipitates of the examples and comparative examples depending on the content of the additives, the number of indentation dynamic strain aging, and the V-bending angle.

TABLE 2

| Example | Ti (wt. %) | Lath spacing (nm) Average | TiC-based precipitation density (/100 $\mu m^2$) Total count | Precipitate size (μm) Average | Indentation dynamic strain aging (pieces) | V-bending (°) |
|---|---|---|---|---|---|---|
| Example 1 | 0.025 | 299 | 20,029 | 0.002 | 25 | 50 |
| Example 2 | 0.032 | 199 | 23,743 | 0.0033 | 29 | 52 |
| Example 3 | 0.036 | 87 | 28,119 | 0.0036 | 32 | 54 |
| Example 4 | 0.047 | 35 | 33,101 | 0.0043 | 36 | 57 |
| Example 5 | 0.05 | 30 | 34,878 | 0.006 | 39 | 54 |
| Example 6 | 0.036 | 85 | 28,513 | 0.0035 | 32 | 53 |
| Example 7 | 0.041 | 32 | 30,498 | 0.0044 | 34 | 55 |
| Comparative example 1 | 0.052 | 25 | 35,341 | 0.0063 | 23 | 44 |
| Comparative example 2 | 0.024 | 325 | 19,899 | 0.0015 | 24 | 46 |

In Table 2, as described above, examples 1 to 7 are examples satisfying the conditions for precipitation behavior of fine precipitates and conditions for forming a plurality of laths depending on the titanium content, as described above. In detail, in examples 1 to 7, titanium may be included in an amount of about 0.025 wt % to 0.050 wt %, and thus the average spacing of the plurality of laths may be about 30 nm to 300 nm, the number of fine precipitates including titanium, for example, titanium carbide (TiC), per unit area may be 20,000/100 $\mu m^2$ or greater and 35,000/100 $\mu m^2$ or less, the average diameter of all the fine precipitates may be 0.002 μm to 0.0006 μm. In this case, the number of indentation dynamic strain aging satisfies the condition of 25 to 39.

As such, examples 1 to 7 satisfying the precipitation behavior condition and the plurality of lath formation conditions of the present invention may secure a V-bending angle of 50° or greater, so it may be confirmed that the tensile strength and bendability are improved.

On the other hand, comparative example 1 and comparative example 2 did not satisfy at least some of the above-described precipitation behavior conditions and plurality of lath formation conditions, so it may be seen that the tensile strength and bendability were reduced compared to examples 1 to 7.

In the case of comparative example 1, as the titanium content is 0.052 wt %, the size of the fine precipitates is coarsened so that the average spacing of the plurality of laths is reduced to about 25 nm, and the indentation dynamic strain aging is 23, which does not satisfy the above-mentioned condition. Accordingly, it may be confirmed that the V-bending angle of comparative example 1 is only 44°.

In the case of comparative example 2, as the titanium content is 0.024 wt %, the size and density of the fine precipitates become less, the average spacing of the plurality of laths increase to about 325 nm, and the indentation dynamic strain aging is 24, which also does not satisfy the above-mentioned conditions. Accordingly, it may be confirmed that the V-bending angle of comparative example 2 is only 46°.

In more detail, fine precipitates in hot stamping components according to an embodiment of the present invention may be included in an amount of 25,000/100 $\mu m^2$ or greater and 30,000/100 $\mu m^2$ or less per unit area (100 $\mu m^2$) in the base steel sheet. In addition, in an exemplary embodiment, the average diameter of the fine precipitates distributed in the base steel sheet may be about 0.006 μm or less. Among these fine precipitates, the ratio of fine precipitates having a diameter of 10 nm or less may be about 90% or greater, and the ratio of fine precipitates having a diameter of 5 nm or less may be 60% or greater. In addition, in an exemplary embodiment, the amount of activated hydrogen in the base steel sheet may be about 0.5 wppm or less. A hot stamping component having such characteristics has excellent bendability and improved resistance to hydrogen embrittlement.

The following Table 3 shows values measured by quantifying the precipitation behavior of the fine precipitates of examples and comparative examples according to the present invention.

The precipitation behavior of fine precipitates may be measured by analyzing a TEM image. In detail, TEM images of arbitrary regions are obtained as many as a preset number of specimens. The fine precipitates may be extracted from the obtained images through an image analysis program, etc., and the number of fine precipitates, the average distance between the fine precipitates, and the diameter of the fine precipitates may be measured for the extracted fine precipitates.

In an exemplary embodiment, in order to measure the precipitation behavior of fine precipitates, a surface replication method may be applied as a pretreatment to the specimen to be measured. For example, a one-step replica method, a two-step replica method, an extraction replica method, and the like may be applied, but are not limited to the above examples.

In another exemplary embodiment, when measuring the diameter of the fine precipitates, the diameter of the fine precipitates may be calculated by converting the shapes of the fine precipitates into circles in consideration of the non-uniformity of the shapes of the fine precipitates. In detail, the diameter of the fine precipitate may be calculated by measuring the area of the extracted fine precipitate using a unit pixel having a specific area and converting the fine precipitate into a circle having the same area as the measured area.

TABLE 3

| pecimen | Total number of fine precipitates (pcs/100 $\mu m^2$) | Overall fine precipitate average diameter (μm) | Percentage of fine precipitates with a diameter of 10 nm or less (%) | Percentage of fine precipitates with a diameter of 5 nm or less (%) | Amount of activated hydrogen (wppm) |
|---|---|---|---|---|---|
| A | 25,010 | 0.0058 | 90.3 | 60.6 | 0.495 |
| B | 25,051 | 0.002 | 98.1 | 90.9 | 0.496 |
| C | 27,413 | 0.004 | 92.9 | 76.2 | 0.455 |
| D | 27,647 | 0.0045 | 94.7 | 73.9 | 0.458 |
| E | 29,054 | 0.0039 | 99 | 72.1 | 0.457 |
| F | 29,991 | 0.0051 | 90 | 61.1 | 0.471 |
| G | 29,909 | 0.0035 | 99.1 | 72.8 | 0.455 |
| H | 25,798 | 0.0055 | 90.1 | 60.8 | 0.452 |
| I | 27,809 | 0.003 | 99.3 | 70.3 | 0.451 |
| J | 27,056 | 0.006 | 98.9 | 77.1 | 0.459 |
| K | 28,386 | 0.0062 | 94.7 | 60.9 | 0.507 |
| L | 29,295 | 0.0042 | 89.7 | 85 | 0.511 |
| M | 24,968 | 0.0058 | 95.9 | 59.9 | 0.503 |
| N | 29,324 | 0.0051 | 54.8 | 59.6 | 0.509 |

In Table 3, the precipitation behavior of fine precipitates (total number of fine precipitates per unit area, average diameter of all fine precipitates, ratio of fine precipitates with a diameter of 10 nm or less, amount of activated hydrogen) of fine precipitates was measured for specimens A to N.

Specimens A to J in Table 3 are examples according to the present invention, and are specimens of hot stamping components manufactured using base steel sheets satisfying the above-described content condition (see Table 1). In other words, specimens A to J are specimens that satisfy the precipitation behavior conditions of the fine precipitates described above. In detail, in specimens A to J, fine precipitates are formed in the steel sheet in an amount of 25,000/100 $\mu m^2$ or greater and 30,000/100 $\mu m^2$ or less, the average diameter of all fine precipitates is 0,006 μm or less, 90% or greater of the fine precipitates formed in the steel sheet have a diameter of 10 nm or less, and 60% or greater satisfy a diameter of 5 nm or less.

It may be seen that the hydrogen delayed fracture characteristics of specimens A to J satisfying the precipitation behavior conditions of the present invention are improved as they satisfy the condition that the amount of activated hydrogen is 0.5 wppm or less.

On the other hand, specimens K to N are specimens that do not satisfy at least some of the above-described precipitation behavior conditions of fine precipitates, and it may be seen that the tensile strength, bendability and/or delayed hydrogen fracture characteristics are inferior to those of specimens A to J.

In the case of specimen K, the average diameter of all fine precipitates is 0.0062 μm. This falls short of the lower limit of the average diameter condition of all fine precipitates. Accordingly, it may be confirmed that the amount of activated hydrogen in specimen K is a relatively high 0.507 wppm.

In the case of specimen L, the ratio of fine precipitates with a diameter of 10 nm or less was measured to be 89.7%. Accordingly, it may be confirmed that the amount of activated hydrogen in specimen L is a relatively high 0.511 wppm.

In the case of specimen M and specimen N, the ratio of fine precipitates with a diameter of 5 nm or less was measured to be 59.9% and 59.6%, respectively. Accordingly, it may be confirmed that the amount of activated hydrogen in specimen M and specimen N is relatively high at 0.503 wppm and 0.509 wppm, respectively.

In cases where the precipitation behavior conditions of the present invention are not satisfied, such as specimens K to N, a relatively large amount of hydrogen is trapped in one fine precipitate during the hot stamping process, or the trapped hydrogen atoms are locally concentrated, and the trapped hydrogen atoms combine with each other to form hydrogen molecules (H2), thereby generating internal pressure. Accordingly, it is judged that the hydrogen delayed fracture characteristics of the hot stamped product are reduced.

On the other hand, in the case of satisfying the precipitation behavior conditions of the present invention, such as specimens A to J, the number of hydrogen atoms trapped in one fine precipitate during the hot stamping process may be relatively less or the trapped hydrogen atoms may be relatively evenly dispersed. Therefore, it is possible to reduce the internal pressure generated by hydrogen molecules formed by the trapped hydrogen atoms. Accordingly, it is judged that the hydrogen delayed fracture characteristics of the hot stamped product are improved.

As a result, as the hot stamping component to which the above-described content condition of the present invention was applied satisfied the above-described precipitation behavior condition of the fine precipitates after hot stamping, it was confirmed that the hydrogen delayed fracture characteristics were improved.

The present invention has been described with reference to the embodiments shown in the drawings, but this is only exemplary, and those skilled in the art will understand that various modifications and other equivalent embodiments are possible therefrom. Therefore, the true technical scope of protection of the present invention should be determined by the technical idea of the appended claims.

The invention claimed is:

1. A hot stamping component comprising a base steel sheet, the base steel sheet comprising carbon (C) in an amount of 0.28 wt % to 0.50 wt %, silicon (Si) in an amount of 0.15 wt % to 0.7 wt %, manganese (Mn) in an amount of 0.5 wt % to 2.0 wt %, phosphorus (P) in an amount of 0.03 wt % or less, sulfur (S) in an amount of 0.01 wt % or less, chromium (Cr) in an amount of 0.1 wt % to 0.6 wt %, boron (B) in an amount of 0.001 wt % to 0.005 wt %, calcium (Ca) in an amount of 0.0012 wt % to 0.0022 wt %, titanium (Ti) in an amount of 0.025 wt % to 0.045 wt %, niobium (Nb) in an amount of 0.015 wt % to 0.045 wt %, molybdenum (Mo) in an amount of 0.05 wt % to 0.15 wt %, and a balance of iron (Fe) and other unavoidable impurities, wherein the base steel sheet includes fine precipitates of nitride and/or carbide of Ti, Nb and/or Mo having an average diameter of 0.002 μm or greater and 0.006 μm or less, wherein a ratio of the fine precipitates having a diameter of 10 nm or less is 90% or greater, wherein the ratio of the fine precipitates having a diameter of 5 nm or less is 60% or more, wherein a number of the fine precipitates distributed per unit area 100 $\mu m^2$ is 25,000 or greater and 30,000 or less, wherein a TiC-based precipitate density distributed per unit area 100 $\mu m^2$ among the fine precipitates is 20,000 pcs/100 $\mu m^2$ to 35,000 pcs/100 $\mu m^2$ or less, wherein the base steel sheet comprises a martensitic structure in which a plurality of lath structures are distributed, wherein an average spacing of the plurality of laths is 30 nm to 300 nm, and wherein, in an indentation strain rate for an indentation depth of 200 nm to 600 nm observed in a nano-indentation test, a number of indentation dynamic strain aging is 25 to 39.

2. The hot stamping component of claim 1, wherein a V-bending angle of the hot stamping component is 50° or greater.

3. The hot stamping component of claim 1, wherein a tensile strength of the hot stamping component is 1680 MPa or greater.

4. The hot stamping component of claim 1, wherein amount of activated hydrogen of the hot stamping component is 0.5 wppm or less.

* * * * *